United States Patent [19]

Loefke et al.

[11] Patent Number: 5,076,703

[45] Date of Patent: Dec. 31, 1991

[54] HYDRAULIC OIL TANK

[75] Inventors: William L. Loefke; Ronald E. Christenson, both of Kasson; Brandon J. McNeilus, Dodge Center

[73] Assignee: McNeilus Truck and Manufacturing, Inc., Dodge Ctr., Minn.

[21] Appl. No.: 470,884

[22] Filed: Jan. 26, 1990

[51] Int. Cl.[5] ..... B28C 5/20

[52] U.S. Cl. ..... 366/61; 220/563

[58] Field of Search ..... 366/61, 60, 62, 63; 220/563

[56] References Cited

U.S. PATENT DOCUMENTS

| | | | |
|---|---|---|---|
| 2,676,003 | 4/1954 | Dury | 366/61 |
| 3,080,152 | 3/1963 | Lendved | 366/61 |
| 3,912,107 | 10/1973 | Baumann | 220/563 |
| 4,453,564 | 6/1984 | Bergesio | 220/563 |
| 4,789,170 | 12/1988 | Reber | 220/563 |

*Primary Examiner*—Robert W. Jenkins

*Attorney, Agent, or Firm*—Merchant, Gould, Smith, Edell, Welter & Schmidt

[57] ABSTRACT

An improved oil tank for storing hydraulic fluid and the hydraulically-powered system is fabricated from a polymeric material which is resistant to chemical breakdown from oil. The tank is constructed in a manner which facilitates internal circulation of hydraulic oil during use. The novel configuration of the tank lends itself to inexpensive fabrication through a rotational molding process. The tank is lightweight, inexpensive to manufacture, and is particularly advantageous for use in vehicle-mounted hydraulic drive systems.

24 Claims, 2 Drawing Sheets

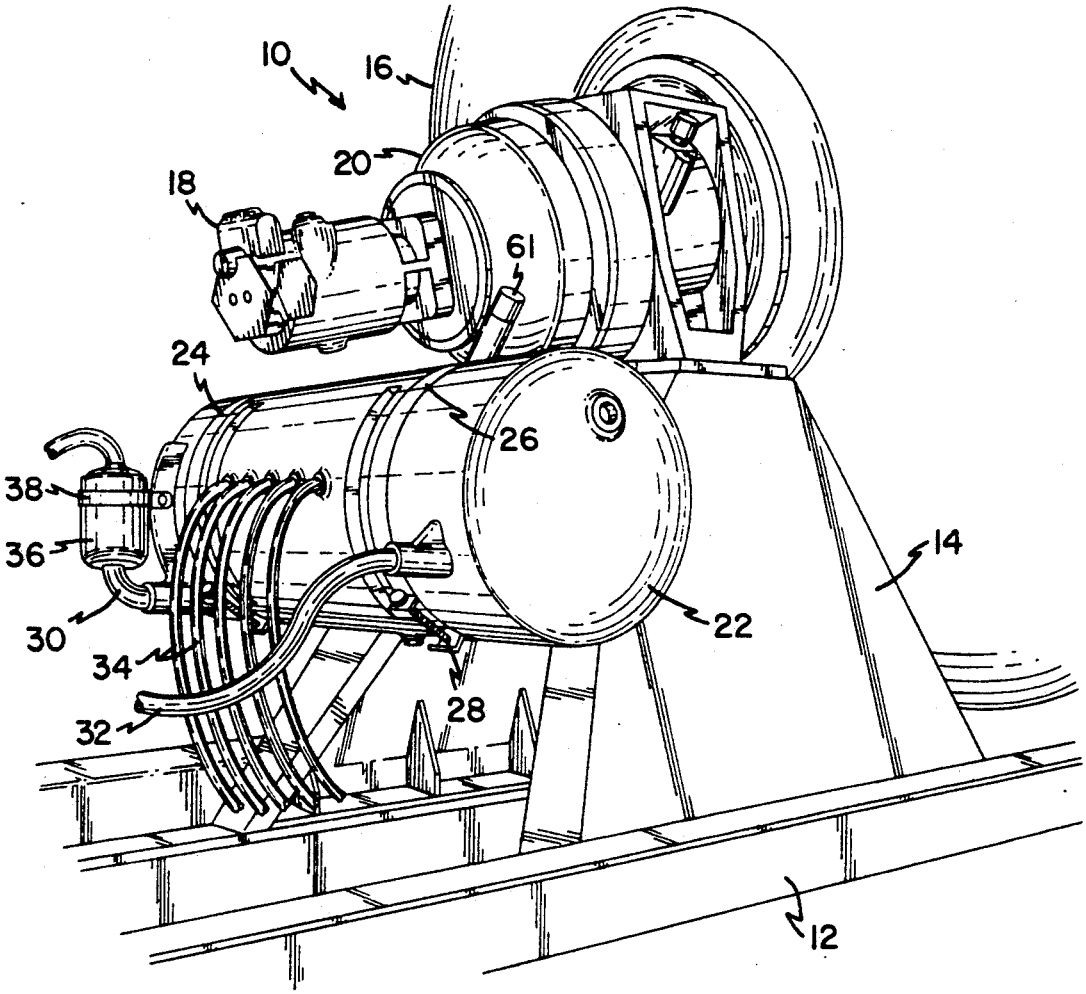
FIG. 1
FIG. 2
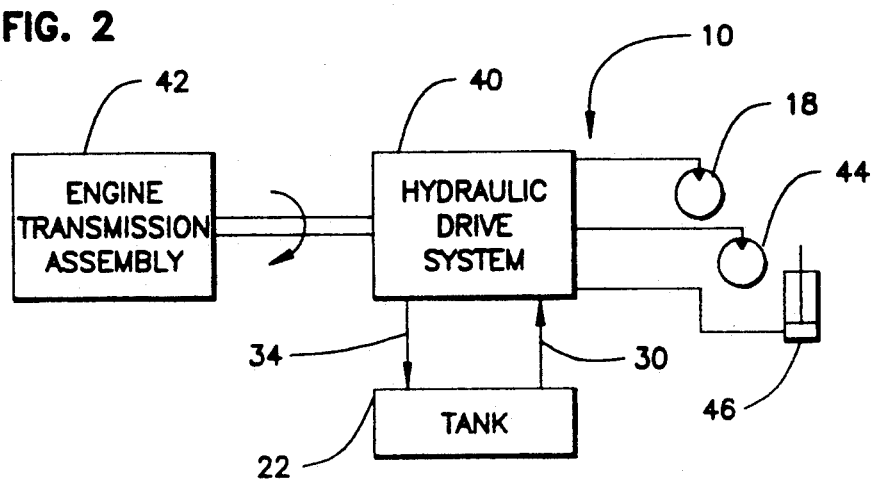

HYDRAULIC OIL TANK

BACKGROUND OF THE INVENTION

1. Field of the Invention

This invention relates to hydraulic systems which are used to power heavy machinery. More specifically, this invention relates to an improved tank for holding hydraulic oil which is used in hydraulic systems.

2. Description of the Prior Art

Hydraulically-powered equipment is common in modern industry, and is especially well-suited for use on vehicular systems which require the efficient transmission of powerful forces. For example, hydraulic operating systems are used to turn mixing drums on mobile cement mixing and dispensing systems which are manufactured by McNeilus Truck and Manufacturing, Inc. of Dodge Center, Minn., which is the assignee of this invention.

In a hydraulic system, an oil tank is typically used to store hydraulic oil while the oil is not being used. In many systems, hydraulic oil is constantly circulating through such a tank. During recirculation, it is advantageous to promote mixing of the oil within the tank to efficiently cool the oil and to achieve its maximum service life.

While existing designs of hydraulic tanks have proven satisfactory in the past, it is recognized that any reductions in the overall weight of such tanks would be advantageous, particularly in vehicle-mounted systems. Likewise, improvements which reduce the manufacturing costs of such tanks would constitute important advances in the art, since they would make hydraulic systems even more economical to purchase and maintain.

It is clear that there has existed a long and unfilled need in the prior art for an improved hydraulic fluid tank which promotes better internal circulation of hydraulic fluid during use, is lighter in weight and is less expensive to manufacture than oil tanks which were heretofore known.

SUMMARY OF THE INVENTION

Accordingly, it is a first object of the invention to provide an improved oil tank for use in hydraulic applications which promotes better internal circulation of fluid than tanks which were previously known.

It is a second object of the invention to provide a hydraulic oil tank which is lighter in weight than tanks which have heretofore been used in conventional vehicular systems.

It is a third object of the invention to provide an improved hydraulic oil tank which is less expensive to manufacture than tank designs heretofore known.

In order to achieve these and other objects of the invention, an improved oil tank according to the invention may include an outer wall defining a closed inside space; inlet nipple structure defined in the outer wall for allowing hydraulic oil to be supplied to a first portion of the inside space; and outlet nipple structure defined in the outer wall for allowing hydraulic oil to be drawn outwardly from a second portion of the inside space, the outer wall being constructed from a lightweight polymeric material which is resistant to chemical breakdown from oil, whereby the weight and cost of the tank is reduced relative to tanks which were heretofore known.

According to a second aspect of the invention, an improved vehicular system for mixing and dispensing concrete may include a truck; a mixing drum mounted for rotation on the truck; and a hydraulic system for selectively turning the mixing drum, the hydraulic system including an oil tank as set forth above.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

FIG. 1 is a fragmentary perspective view illustrating a vehicular system having an improved oil tank according to a preferred embodiment of the invention;

FIG. 2 is a schematic diagram depicting a hydraulic drive arrangement for use in the system which is shown in FIG. 1;

DETAILED DESCRIPTION OF THE PREFERRED EMBODIMENT

Figure 3:
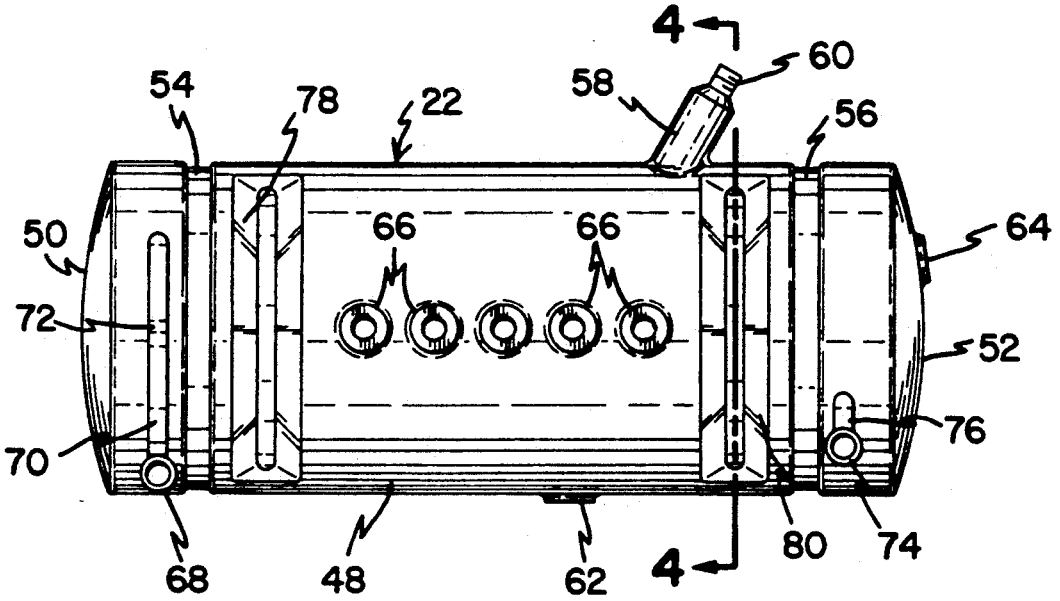
FIG. 3 is a side elevational view of the oil tank that is illustrated in FIG. 1.

Referring now to the drawings, wherein like reference numerals designate corresponding structure throughout the views, and referring particularly to FIG. 1, an improved vehicular system 10 for mixing and dispensing concrete includes a truck body having a chassis 12 and a drum support 14, upon which a concrete mixing drum 16 is supported for rotation. A hydraulic motor 18 is connected in conventional fashion to an axis of mixing drum 16 for selectively turning mixing drum 16 in a first direction during mixing or in a second direction for discharging the concrete mixture. A transmission assembly 20 is provided for transmitting mechanical energy from motor 18 to the mixing drum 16. The specific construction of motor 18, transmission assembly 20 and drum 16 is conventional and well known in the industry.

As is also illustrated in FIG. 1, an improved hydraulic oil tank 22 is secured to drum support 14 by a first holddown strap 24 and a second holddown strap 26. Clamps 28 are used to secure the holddown straps 24, 26 in a manner which will be evident to those skilled in the art.

System 10 further includes a first outlet line 30 and a second outlet line 32 which supplies hydraulic fluid from tank 22 to a hydraulic pump or other system component. An oil filter 36 is interposed in first outlet line 30 for removing particulate matter from hydraulic fluid which is drawn through first outlet line 30. Hydraulic return lines 34 are provided for returning hydraulic oil to tank 22 after use. A bracket 38 is used to secure filter 36 to the hydraulic oil tank 22. Although bracket 38 is not necessary to maintain the position of filter 36 during normal operation, it reduces the possibility of damage to the first outline line 30 or tank 22 if strong external forces are brought to bear on filter 36. More specifically, bracket 38 protects filter 36 and tank 22 against damage if a person improperly tries to use filter 36 as a stepping place in an attempt to gain access to components of system 10 which would otherwise be impossible to reach.

Looking now to FIG. 2, system 10 includes a hydraulic drive system 40 that receives mechanical power from an engine transmission assembly 42. System 40 includes at least one hydraulic pump, a control system and other components which are conventional and well-known to those skilled in the art. System 40 is in communication with the improved hydraulic oil tank 22 via the first outlet line 30, and the hydraulic return lines 34. System 40 is also in communication with hydraulic motor 18, and may be connected to additional hydraulically-powered motors 44, 46 as may be required.

Referring now to FIG. 3, tank 22 has an outer wall 39 which has generally cylindrical outside surface 48, a first end surface 50 and a second end portion 52. As may be seen in FIG. 4, outer wall 39 thus defines a closed inside space 41 which may be used for containing hydraulic fluid.

Looking again to FIG. 3, a first circumferential recess 54 and a second circumferential recess 56 are adapted for receiving the first and second holddown straps 24, 26, respectively. In this way, tank 22 is secured against axial movement with respect to the holddown straps 24, 26 when they are secured into the position which is illustrated in FIG. 1.

Tank 22 further includes a filler spout 58, which projects out of a top portion of cylindrical surface 48. Filler spout 58 has a threaded end nipple 60 which is sealable by a threaded cap 61, shown in FIG. 1. Tank 22 further includes a drain plug 62 which is provided on a bottom portion of cylindrical surface 48, and a sight level gauge 64, which can be used to visually check the level of hydraulic fluid within tank 22. Drain plug 62 is preferably threaded into a mating threaded bore in outer wall 39. Sight level gauge 64 preferably includes an insert of glass or an equivalent material through which light can pass, as is well known in the art.

Figure 4:
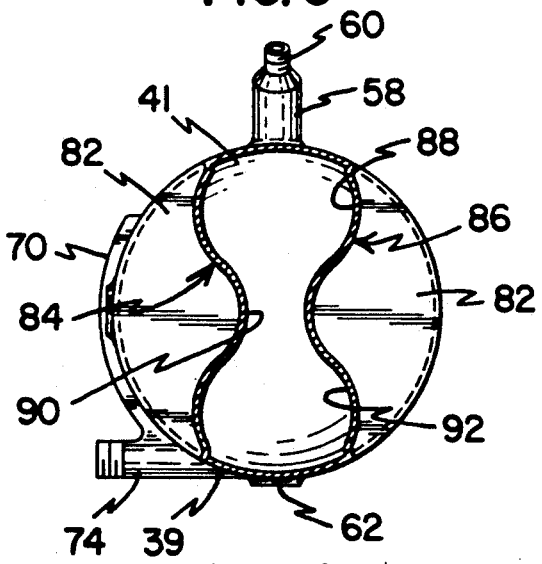
FIG. 4 is a cross sectional view taken along lines 4—4 in FIG. 3.

A plurality of raised inlet nipples 66 are defined on a side portion of cylindrical surface 48, as may be seen in FIGS. 3 and 4. Each of the nipples 66 preferably includes a threaded bore into which a male connector on each of the hydraulic return lines 34 can be threaded. As a result, the space 41 inside tank 22 can be communicated with each of the various hydraulic return lines 34 so that hydraulic oil can be returned into tank 22 after use.

Looking again to FIGS. 3 and 4, a first outlet nipple 68 projects tangentially from a lower portion of cylindrical surface 48. Similarly, a second outlet nipple 74 projects from a lower portion of cylindrical surface 48 on a second end of tank 22. A reinforcing brace rib 70 is provided along a circumference of surface 48 immediately above first outlet nipples 68. Brace rib 70 is preferably unitary with the outer wall 39 of tank 22 and serves to give additional rigidity to first outlet nipple 68. Brace rib 70 further has a bore 72 defined therein for receiving an insert, as may be seen in FIG. 3. Bore 72 is sized for receiving a pin or equivalent connector, which is used to secure bracket 38 to brace rib 70, as is clearly shown in FIG. 1. In this way, brace rib 70 reinforces the outer wall 39 of tank 22 against external forces which may be transmitted from the oil filter 36 via bracket 38. Similarly, a reinforcement web 76 is provided circumferentially along the surface 48 above second outlet nipple 74, as is shown in FIGS. 3 and 4. Reinforcement web 74 gives additional rigidity to second outlet nipple 74. Reinforcement web 76 is unitary with the outer wall 39 of tank 22. Additional built-up thickened areas are provided around nipples 66, 68, 74, filler spout 58 and drain plug 62 for structural reinforcement purposes.

As may best be seen in FIGS. 3 and 4, the invention includes a baffle system on outer wall 39 which restricts oil flow between a first portion of inside space 41 which is in communication with the inlet nipples 66, and a second portion of inside space 41 which is in communication with first and second outlet nipples 68, 74. When viewed externally as is shown in FIG. 3, the baffle system has the appearance of a first inset area 78 which extends radially inwardly along a circumference of cylindrical surface 48, and a second inset area 80 which likewise extends radially inwardly along a circumference of surface 48 which is axially spaced from first inset area 78. As may be seen in FIG. 4, which provides a cross sectional view of second inset area 80, each of the inset areas 78, 80 are defined by a pair of side surfaces 82 which extend both radially inwardly and axially in a direction toward each other to an innermost external surface. Side surfaces 82 and the innermost external surface together define a first dividing baffle 84 and a second dividing baffle 86 for each of the inset areas 78, 80 as they are viewed in FIG. 3.

As may be seen in FIG. 4, both the first and second dividing baffles 84, 86 are provided with a concave upper surface 88, a convexly curved middle surface 90 and a concave lower surface 92. These surfaces constrict a portion of inside space 41 into an hourglass-type cross section in a pair of planes which are positioned between a first portion of inside space 41 which is in communication with inlet nipples 66, and two second portions of inside space 41 which are in communication with the first and second outlet nipples 68, 74 respectively. As a result, hot hydraulic fluid returning from other components of system 10 is prevented from directly re-entering either the first or second outlet nipple 68, 74. Instead, a circulation pattern is set up within tank 22 which promotes cooling and lengthens the life of the hydraulic oil.

According to one important feature of the invention, the entire structure of tank 22 is preferably constructed of a lightweight polymeric material which is resistant to chemical breakdown from oil. Examples of the materials which are contemplated by the inventors for use in fabricating tank 22 are polystyrenes, polyethylenes, ABS polymers and polyamides such as nylon. The most preferred polymer for forming tank 22 at the time an application for patent was filed is Nylon-12.

In order to prevent scission or related degradation from sunlight, the polymer which is used to form tank 22 is preferably impregnated with an ultraviolet inhibiting or absorbing agent, both of which are readily known and available to those skilled in the art.

Besides providing effective mixing of hydraulic fluid during operation, the configuration of tank 22 and baffles 84, 86 as shown in FIGS. 3 and 4 give substantial manufacturing advantages to a tank which is constructed according to the invention. Specifically, the symmetrical design and open curves of the tank 22 make it particularly adapted for rotational molding.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An improved vehicular system for mixing and dispensing concrete, comprising:

a truck;

a hydraulic system on said truck, said hydraulic system including an improved oil tank comprising an outer wall defining a closed inside space;

inlet nipple means defined in said outer wall for allowing hydraulic oil to be supplied to a first portion of said inside space; and an outlet nipple means defined in said outer wall for allowing hydraulic oil to be drawn outwardly from a second portion of said inside space, said outer wall being constructed from a lightweight polymeric material which is resistant to chemical breakdown from oil, whereby the weight and cost of said tank is reduced relative to tanks which were heretofore known.

2. A system according to claim 1, said oil tank further comprising baffle means on said outer wall for restricting oil flow between said first portion and said second portion of said inside space, whereby hydraulic oil entering through said inlet nipple means is caused to circulate before it can be drawn out through said outlet nipple means.

3. A system according to claim 2, wherein said baffle means is unitary with said outer wall.

4. A system according to claim 3, wherein said baffle means comprises at least one inset area of said outer wall.

5. A system according to claim 4, wherein said baffle means comprises two of said inset area.

6. A system according to claim 1, said oil tank further comprising means defined in said outer wall which is adapted for receiving a holddown strap.

7. A system according to claim 1, said oil tank further comprising means adapted for bracing an oil filter against external forces, said bracing means bring integral with a portion of said outer wall.

8. A system according to claim 7, wherein said bracing means is unitary with said outer wall.

9. A system according to claim 1, wherein said polymeric material is selected from the group of polymers which includes polyamides, polystyrenes, polyethylenes and ABS polymers.

10. A system according to claim 9, wherein said polymeric material comprises Nylon-12.

11. A system according to claim 1, wherein said polymeric material includes an inhibitor for preventing degradation from ultraviolet light.

12. An improved vehicular system for mixing and dispensing concrete, comprising:

a truck;

a mixing drum mounted for rotation on said truck; and hydraulic means for selectively turning said mixing drum, said hydraulic means including an improved oil tank comprising an outer wall defining a closed inside space; inlet nipple means defined in said outer wall for allowing hydraulic oil to be supplied a first portion of said inside space; and outlet nipple means defined in said outer wall for allowing hydraulic oil to be drawn outwardly from a second portion of said inside space, said outer wall being constructed from a lightweight polymeric material which is resistant to chemical breakdown from oil, whereby the weight and cost of said tank is reduced relative to tanks which were heretofore known.

13. An oil tank according to claim 12, further comprising baffle means on said outer wall for restricting oil flow between said first portion and said second portion of said inside space, whereby hydraulic oil entering through said inlet nipple means is caused to circulate before it can be drawn out through said outlet nipple means.

14. An oil tank according to claim 13, wherein said baffle means is unitary with said outer wall.

15. An oil tank according to claim 14, wherein said baffle means comprises at least one inset area of said outer wall.

16. An oil tank according to claim 15, wherein said baffle means comprises two of said inset areas.

17. An oil tank according to claim 12, further comprising means defined in said outer wall which is adapted for receiving a holddown strap.

18. An oil tank according to claim 12, further comprising means adapted for bracing an oil filter against external forces, said bracing means bring integral with a portion of said outer wall.

19. An oil tank according to claim 18, wherein said bracing means is unitary with said outer wall.

20. An oil tank according to claim 12, wherein said polymeric material is selected from the group of polymers which includes polyamides, polystyrenes, polyethylenes and ABS polymers.

21. An oil tank according to claim 20, wherein said polymeric material comprises Nylon-12.

22. An oil tank according to claim 12, wherein said polymeric material includes an inhibitor for preventing degradation from ultraviolet light.

23. An improved oil tank for use with a hydraulic operating system, comprising:

an outer wall defining a closed inside space;

inlet nipple means defined in said outer wall for allowing hydraulic oil to be supplied to a first portion of said inside space;

outlet nipple means defined in said outer wall for allowing hydraulic oil to be drawn outwardly from a second portion of said inside space, said outer wall being constructed from a lightweight polymeric material which is resistant to chemical breakdown from oil, whereby the weight and cost of said tank is reduced relative to tanks which were heretofore known; and means adapted for bracing an oil filter against external forces, said bracing means being integral with a portion of said outer wall.

24. An oil tank according to claim 23, wherein said bracing means is unitary with said outer wall.

* * * * *

UNITED STATES PATENT AND TRADEMARK OFFICE

CERTIFICATE OF CORRECTION

PATENT NO. : 5,076,703

DATED : 12/31/91

INVENTOR(S) : William L. Loefke

It is certified that error appears in the above-identified patent and that said Letters Patent is hereby corrected as shown below:

Title page, at [75], line 2, after "Kasson" insert --MN--.

Title page, at [75], line 3, after "Dodge Center" insert --MN--.

Title page, at [75], line 4, insert --Terry D. Grabow, Red Wing, MN-- as inventor.

Col. 5, line 36, for "area" read --areas--.

Col. 5, line 42, for "bring" read --being--.

Col. 6, line 1, after "supplied" insert --to--.

Col. 6, line 31, for "bring" read --being--.

Signed and Sealed this

First Day of June, 1993

*Attest:*

Michael K. Kirk

MICHAEL K. KIRK

*Attesting Officer*

*Acting Commissioner of Patents and Trademarks*